US007857716B2

(12) United States Patent
Cheng et al.

(10) Patent No.: US 7,857,716 B2
(45) Date of Patent: Dec. 28, 2010

(54) GOLF BALL

(75) Inventors: Hsin Cheng, Yun-Lin Hsien (TW); Chien-Hsin Chou, Yun-Lin Hsien (TW)

(73) Assignee: Feng Tay Enterprise Co., Ltd., Yun-Lin Hsien (TW)

( * ) Notice: Subject to any disclaimer, the term of this patent is extended or adjusted under 35 U.S.C. 154(b) by 332 days.

(21) Appl. No.: 12/071,627

(22) Filed: Feb. 25, 2008

(65) Prior Publication Data

US 2009/0215554 A1 Aug. 27, 2009

(51) Int. Cl.
*A63B 37/12* (2006.01)

(52) U.S. Cl. ..... 473/383

(58) Field of Classification Search ..... 473/383–385
See application file for complete search history.

(56) References Cited

U.S. PATENT DOCUMENTS

| | | | | |
|---|---|---|---|---|
| 698,516 | A | 4/1902 | Kempshall | |
| 712,413 | A | 10/1902 | Richards | |
| 5,836,834 | A | 11/1998 | Masutani et al. | |
| 6,296,578 | B1 * | 10/2001 | Masutani | 473/368 |
| 6,379,270 | B2 | 4/2002 | Maruko et al. | |
| 6,383,091 | B1 * | 5/2002 | Maruko et al. | 473/373 |
| 2003/0158000 | A1 * | 8/2003 | Kennedy et al. | 473/371 |

* cited by examiner

*Primary Examiner*—Raeann Trimiew
(74) *Attorney, Agent, or Firm*—Bacon & Thomas, PLLC

(57) ABSTRACT

In a golf ball, the surface of the core layer has a predetermined number of depressions, and the depressions have a predetermined total volume. By means of the aforesaid structural design, the spin rate of the golf ball is effectively controlled, and the golf ball has the advantages of simple design and high productivity.

14 Claims, 3 Drawing Sheets

GOLF BALL

BACKGROUND OF THE INVENTION

1. Field of the Invention

The present invention relates to golf balls and more particularly, to such a golf ball that has a predetermined number of depressions on the surface of the core having at least one layer and the depressions have a predetermined total volume.

2. Description of the Related Art

In a conventional golf ball, the core is spherical and has a smooth surface. When a golf ball of this design is hit with a driver club, the ball is forced to spin at a high speed, shortening the ball carry and lowering the player's performance.

U.S. Pat. No. 698,516 discloses a three-piece golf ball in which the inner layer is made out of soft rubber, the intermediate layer is made out of gutta-percha and has depressions on the surface, and the outer layer is made out of celluloid. A golf ball of this design is durable in use. U.S. Pat. No. 712,413 discloses a three-piece golf ball in which the core is made out of soft rubber, the intermediate layer is made out of hard rubber and has fine through holes, and the cover is made out of tough rubber. A golf ball of this design has the characteristics of low cost and high durability. U.S. Pat. No. 5,836,834 discloses a three-piece golf ball comprising a two-layer solid core and a cover of ionomer resin, which encloses the two-layer solid core. The two-layer solid core consists of an inner core of low-hardness rubber and an outer core of high-hardness rubber disposed around the inner core with a boundary surface therebetween, wherein a plurality of projections are formed on the inner surface of the outer core such that the projections extend along an approximate radial direction, a plurality of depressions corresponding to the projections are formed in the outer surface of the inner core, the inner core and the outer core joined together such that the projections are closely inserted into the depressions, and the projections and the depressions are uniformly arranged over the entire boundary surface between the inner core and the outer core. When hitting a ball of this design with a driver club, the player will get a relatively hard feel. When hitting a ball of this design with a short iron, the player will get a relatively soft feel. However, the specifications of the aforesaid patents do not describe the characteristics of the detail construction, amount and distribution of the depressions and the effect of the depressions relative to the spin rate.

U.S. Pat. Nos. 6,379,270 and 6,383,091 disclose a similar concept. According to these two patents, the golf ball comprises a solid core, an intermediate layer, and a cover. The solid core or the cover is provided with a plurality of protrusions penetrating into the intermediate layer. The Shore D hardness value of the protrusions is greater than the intermediate layer. When the ball is driven with a driver club, the protrusions are forced to bend, resulting in a great amount of deformation of the ball, and therefore the spin rate of the ball is reduced and the flight performance is improved. When hitting the ball with a short iron, the protrusions do not bend and the amount of deformation of the ball is insignificant, and therefore the protrusions do not cause reduction of the spin rate and the flight of the ball is well controlled.

According to Table 3 of the specifications of U.S. Pat. Nos. 6,379,270 and 6,383,091, the number of the protrusions is more than one hundred, and their maximum cross-sectional size is 0.5 to 2.5 mm. During fabrication, it is difficult to strip off the core from the mold, resulting in low production efficiency and low yield rate. Further, when designing the ball, the designer must take the length and the pitch of the arrangement of the protrusions into account, preventing interference among protrusions and lowering the effect of the protrusions on the spin rate. These factors complicate the ball design.

Therefore, it is desirable to provide a golf ball that eliminates the aforesaid drawbacks.

SUMMARY OF THE INVENTION

The present invention has been accomplished under the circumstances in view. It is therefore one object of the present invention to provide a golf ball in which the surface of the core has a predetermined number of depressions and the depressions have a predetermined total volume so that the spin rate of the ball is effectively controlled, the golf ball production efficiency is greatly improved, and the design of the golf ball is relatively easier than the prior art.

To achieve this and other objects and according to one aspect of the present invention, a multi-piece solid golf ball is provided, comprising a core, and a cover of at least one layer enclosing the core. The core has multiple layers and a plurality of depressions formed on the surface of at least one of the layers. The number of the depressions is 6 to 70. The total volume of the depressions is 0.025 to 3.4 $cm^3$.

The special design of the depressions interrupts the smooth transmission of the spinning energy of the ball when the ball is hit with a driver club, thereby enhancing loss of the spinning-energy. When compared with conventional designs, the invention effectively reduces the spin rate and increases the ball carry when the golf ball is hit with a driver club. Therefore, a player using a golf ball made according to the present invention can get better performance. When the ball of the present invention is hit with a short iron, the pressure transferring direction is different from the hitting action with a driver club, and the depressions do not affect the spin rate of the ball, and therefore the ball is forced to spin at a high speed and the direction of flight of the ball is well controlled. Further, the number and total volume of the depressions are controlled within a predetermined range to facilitate the design of the ball and the separation of the core from the mold during the fabrication. Therefore, the invention greatly improves the production efficiency and yield rate, suitable for mass production.

In one embodiment of the present invention, the depressions can be formed on the surface of single layer of multi-piece solid core. In another embodiment of the present invention, the depressions can be formed on the surface of every layer of the multi-piece solid core without affecting the effect of reducing the spin rate of the ball when the ball is hit with a driver club. The number, total volume, depth and maximum cross-sectional size of the depressions are preferably controlled under the conditions of 10 to 50, 0.1 to 2.8 $cm^3$, greater than 1 mm, and greater than 5 mm respectively. The maximum Shore D hardness of the core is preferably from 35 to 60 so that the player can get a good feel when hitting the ball. Further, at least one core layer is made out of a thermosetting material or thermoplastic material.

A multi-piece solid golf ball can be a three-piece solid golf ball comprising an inner core, an outer core, and a cover. Alternatively, the golf ball of the present invention can be a two-piece solid golf ball comprising a core and a cover of one single layer that encloses the core, or a multi-piece solid golf ball comprising a core and a multilayer cover enclosing the core.

DETAILED DESCRIPTION OF THE INVENTION

Figure 1:
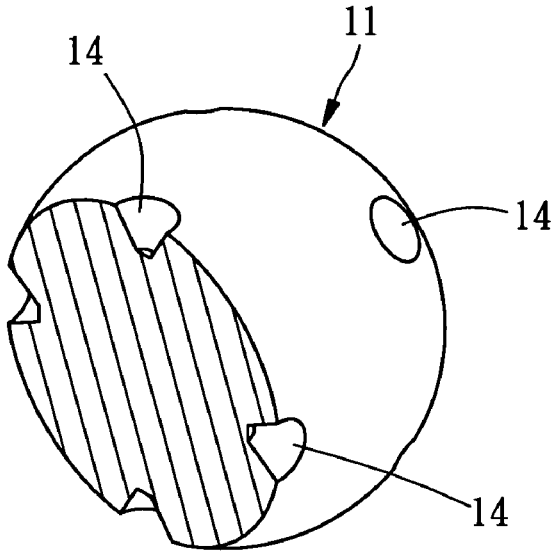
FIG. 1 is a sectional elevation of a solid core for a golf ball in accordance with a first embodiment of the present invention.
Figure 2:
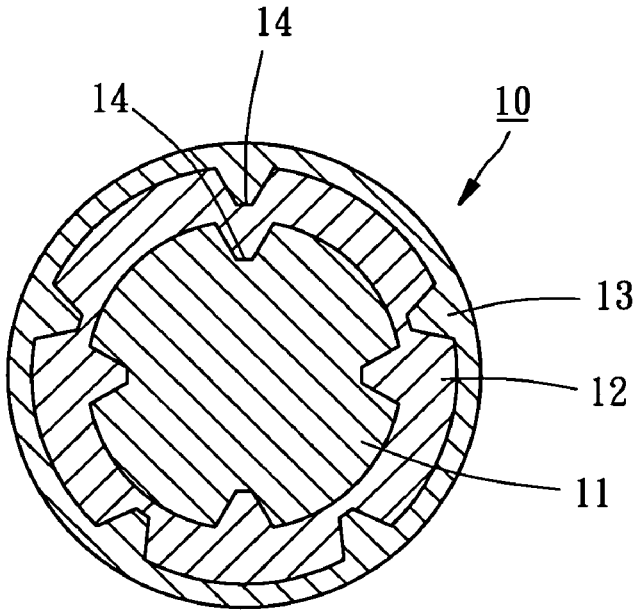
FIG. 2 is a cross-sectional view of a golf ball in accordance with a first embodiment of the present invention.

Referring to FIGS. 1 and 2, a golf ball in accordance with a first embodiment of the present invention is a three-piece solid golf ball 10, comprising an inner core 11, an outer core 12 enclosing the solid inner core 11, and a cover 13 enclosing the outer core 12. The inner core 11 and outer core 12 each has a plurality of depressions 14 on its surface. The total number of the depressions 14 is controlled within 6 to 70. The total volume of the depressions 14 is controlled within 0.025 to 3.4 $cm^3$. Preferably, the total number of the depressions 14 is within 10 to 50, and the total volume of the depressions 14 is within 0.1 to 2.8 $cm^3$. It is to be understood that if the total volume of the depressions 14 is below 0.025 $cm^3$, the structural effect of the depressions 14 will be drastically reduced and the spin rate of the golf ball will not be effectively reduced when the golf ball is hit with a driver club. Further, the depressions 14 have a depth greater than 1 mm, and a maximum cross-sectional size greater than 5 mm. Preferably, the depressions 14 have a depth greater than 1.5 mm. It is to be understood that if the depth of the depressions 14 is smaller than 1 mm, the structural effect of the depressions 14 will be drastically reduced and the spin rate of the golf ball will not be effectively reduced when the golf ball is hit with a driver club.

Further, the number of the depressions 14 of the solid inner core 11 according to this embodiment is preferably greater than 10, and the number of the depressions 14 of the outer core 12 is preferably greater than the number of the depressions 14 of the inner core 11. Further, the depressions 14 can be shaped like, but not limited to, a hemisphere, cone, cylinder, prism, or rectangular block. Preferably, the depressions 14 are shaped like a cone.

Please refer to the data listed in the following Tables I to IV. From the indications of Examples 1 and 2 and Comparative Example 1, it is apparent that a three-piece solid golf ball in accordance with the first embodiment of the present invention effectively reduces the spin rate when the golf ball is hit with a driver club, and effectively improves the spin rate when the golf ball is hit with a short iron. Because the total number and total volume of the depressions 14 are properly controlled, the design and fabrication of the golf ball in accordance with the present invention are relatively simpler and easier than the prior art. In other words, the number of the depressions 14 of a golf ball in accordance with the present invention is relatively smaller than the prior art designs and the maximum cross-sectional size of the depressions 14 of a golf ball in accordance with the present invention is relatively greater than the prior art designs, therefore the separation of the solid inner core 11 or outer core 12 from the mold during the fabrication of a golf ball in accordance with the present invention is relatively easier than the prior art designs. Therefore, the invention greatly improves the production efficiency and yield rate, suitable for mass production.

Figure 3:
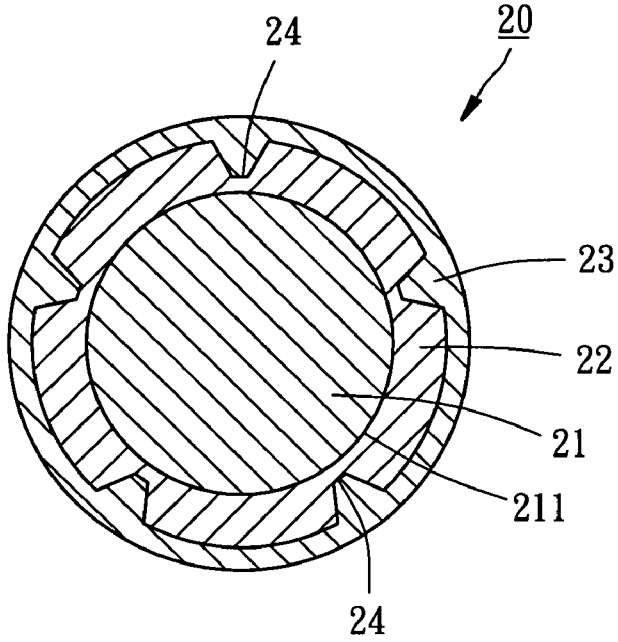
FIG. 3 is a cross-sectional view of a golf ball in accordance with a second embodiment of the present invention.

Further, the depressions can be limited to the surface of single core layer. For example, FIG. 3 is a cross-sectional view of a three-piece solid golf ball 20 in accordance with a second embodiment of the present invention. According to this second embodiment, the three-piece solid golf ball 20 comprises an inner core 21, an outer core 22 enclosing the inner core 21, and a cover 23 enclosing the outer core 22. The inner core 21 has a smooth surface 211. The outer core 22 has a plurality of depressions 24.

Figure 4:
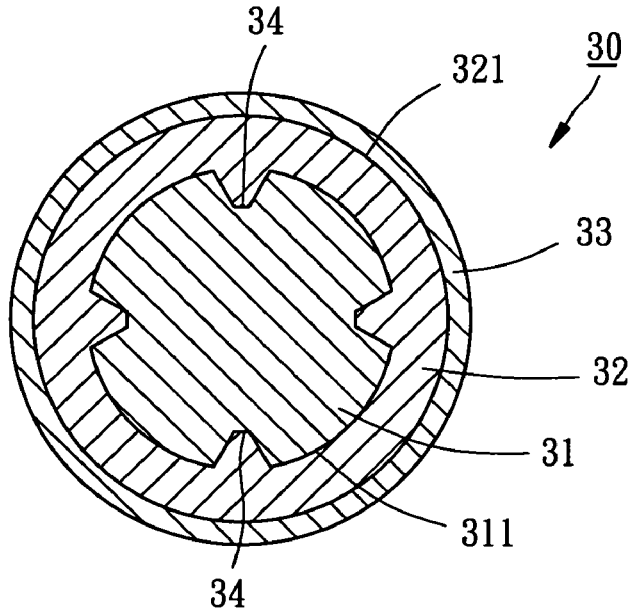
FIG. 4 is a cross-sectional view of a golf ball in accordance with a third embodiment of the present invention.

FIG. 4 is a cross-sectional view of a three-piece solid golf ball 30 in accordance with a third embodiment of the present invention. According to this third embodiment, the three-piece solid golf ball 30 comprises an inner core 31, an outer core 32 enclosing the inner core 31, and a cover 33 enclosing the outer core 32. The inner core 31 has a plurality of depressions 34 on the surface 311 thereof. The outer core 32 has a smooth surface 321. According to tests, when the number, volume, depth and maximum cross-sectional size of the depressions 34 are controlled under the conditions of 6 to 70, 0.025 to 3.4 $cm^3$, greater than 1 mm and greater than 5 mm respectively, the golf ball achieves the same effects as the aforesaid first and second embodiments.

Figure 5:
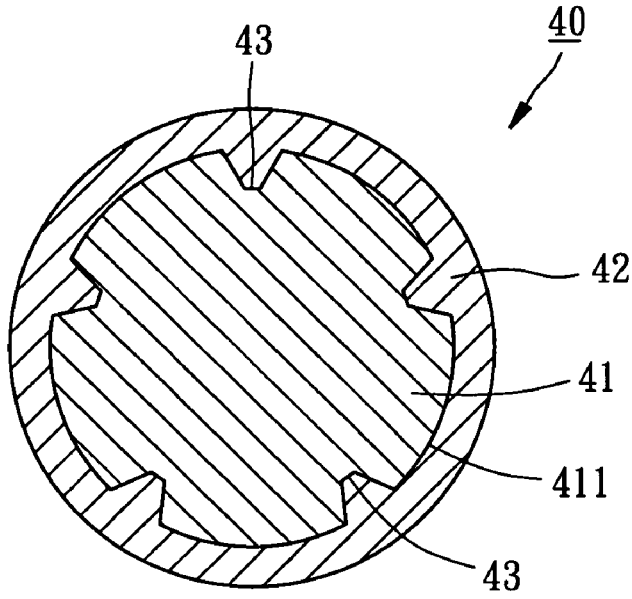
FIG. 5 is a cross-sectional view of a golf ball in accordance with a fourth embodiment of the present invention.

FIG. 5 is a cross-sectional view of a two-piece solid golf ball 40 in accordance with a fourth embodiment of the present invention. According to this fourth embodiment, the two-piece solid golf ball 40 comprises a core 41, and a cover 42 enclosing the core 41. The core 41 has a plurality of depressions 43 on the surface 411 thereof. The number, volume, depth and maximum cross-sectional size of the depressions 43 are controlled under the conditions of 6 to 70, 0.025 to 3.4 $cm^3$, greater than 1 mm and greater than 5 mm respectively. From the indications of Examples 7 and 8 and Comparative Example 4 as shown in Table IV, it is apparent that a two-piece solid golf ball in accordance with the fourth embodiment of the present invention effectively reduces the spin rate when the golf ball is teed off with a driver club, and effectively improves the spin rate when the golf ball is hit with a short iron.

Figure 6:
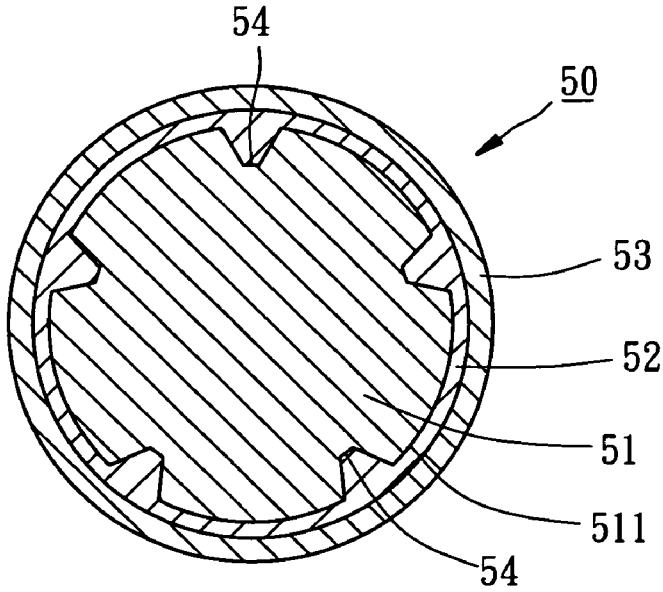
FIG. 6 is a cross-sectional view of a golf ball in accordance with a fifth embodiment of the present invention.

In the aforesaid fourth embodiment of the present invention, the golf ball 40 has one cover 42. However, one single layer of cover is not a limitation. FIG. 6 is a cross-sectional view of a golf ball 50 in accordance with a fifth embodiment of the present invention. According to this fifth embodiment, the golf ball 50 comprises a solid core 51, which has a plurality of depressions 54 on the surface 511 thereof, an inner cover 52 enclosing the solid core 51, and an outer cover 53 enclosing the inner cover 52. The number, volume, depth and maximum cross-sectional size of the depressions 54 are controlled under the conditions of 6 to 70, 0.025 to 3.4 $cm^3$, greater than 1 mm and greater than 5 mm respectively. From the indications of Examples 5 and 6 and Comparative Example 3 as shown in Table IV, it is apparent that a solid golf ball in accordance with the fifth embodiment of the present invention achieves the same effects as the aforesaid $1^{st}$~$4^{th}$ embodiments of the present invention.

After understanding of the structure of the golf ball, the materials of the golf ball are explained hereinafter with reference to Tables I, II and III.

The material of the core is selected from a group comprising thermoplastic materials, thermosetting materials, and combinations thereof. Suitable thermoplastic materials are thermoelastomers such as, but not limited to, ionomer resin, polyamide resin, polyester resin, polyurethane resin, and combinations thereof. Of these, the ionomer resin is preferred. Suitable thermosetting materials include, but not limited to, rubber, styrene butadiene, polybutadiene, isoprene, polyisoprene, polyurethane, and combinations thereof. Of these, polybutadiene is preferred.

If the core of the golf ball is formed of at least two layers, the material of at least one core layer is selected from a thermoplastic material or thermosetting material, and any suitable thermoplastic or thermosetting material can be used for the cover.

When a thermosetting material, for example, rubber compound is selected for the core, many base rubbers can be used, such as 1,4-cis-polybutadiene, polyisoprene, styrene-butadiene copolymers, natural rubber, and combinations thereof. To obtain a better elastic performance, 1,4-cis-polybutadiene is preferred. Alternatively, 1,4-cis-polybutadiene can be used as the base material for the core layer and mixed with other ingredients. However, the amount of 1,4-cis-polybutadiene should be at least 50 parts by weight, and more preferably over 70 parts by weight, based on 100 parts by weight of the rubber compound.

In addition to the base rubber of 1,4-cis-polybutadiene, other additives such as crosslinking agent and filler may be added. A suitable crosslinking agent can be selected from a group comprising zinc acrylate, magnesium acrylate, zinc methacrylate and magnesium methacrylate. In consideration of elasticity, zinc acrylate is preferred. Further, to increase the specific gravity, the core may be mixed with a filler that can be selected from the group comprising zinc oxide, barium sulfate, calcium carbonate, and magnesium carbonate. Among these fillers, zinc oxide is preferred. Further, a metal powder of high specific gravity, for example, tungsten can be used as a filler. By means of adjusting the added amount of the filler, the specific gravity of the core can reach the desired level.

During fabrication, the prepared materials are well mixed into a rubber compound by means of a kneader, Banbury mixer or roll mill, and then the rubber compound is premolded into a slug at a mold temperature of 85° C., and then the slug thus obtained is processed through a curing process at a mold temperature of 125 to 165° C. for about 6 to 12 minutes.

If a thermoplastic material is adopted for the core, it can be selected from the group comprising ionomer resin, polyamide resin, polyester resin and polyurethane resin. Among these resins, ionomer resin is preferred. Suitable commercial ionomer resins include Surlyn®, HPF1000, and HPF2000, commercially available from E. I. DuPont de Nemours and Company, and IOTEK®, commercially available from Exxon Corporation. The prepared material can be processed into the desired solid core by means of hot-press molding or injection molding, and injection molding is preferred. When injection molding is adopted, the temperature of the injection molding machine is controlled within 190 to 220° C.

Further, the Shore D hardness of the core of the present invention is preferably controlled within 35 to 60. If the Shore D hardness is below 35, the elasticity of the ball will be insufficient. If the Shore D hardness surpasses 60, the player will not have a good feel when hitting the ball.

The fabrication of the golf balls of the aforesaid various embodiments can be done by means of: employing a hot-press molding or injection molding technique to make an inner core having a smooth outer surface without any depression, and then drilling the smooth surface of the inner core to provide the desired depressions, and then employing a hot-press molding or injection molding technique to produce an outer core that encloses the inner core, and then drilling the outer core when desired, and then making one or multiple cover layers that enclose the outer core. The outermost cover layer is provided with dimples. After the formation of the outermost cover layer, the surface of the ball is printed with the desired pattern (for example, logo), and then coated with a coating layer.

Using molds is the preferable method of fabrication of a solid core with depressions. By means of the design of protrusions in the surface of the cavity of the mold corresponding to the desired depressions, the fabrication of the solid core with depressions is simple. The mold can be conventional hot-press mold or injection mold. During fabrication, the inner core is made at first, and then the outer core is formed on the surface of the inner core, and then one cover layer or multiple cover layers are formed on the surface of the outer core by means of injection molding or hot-press molding. The outermost cover layer is provided with dimples. After the formation of the outermost cover layer, the surface of the ball is printed with the desired pattern (for example, logo), and then coated with a coating layer.

In conclusion, the special depression design of the present invention interrupts the smooth transmission of the spinning energy of the ball when the ball is hit with a driver club, thereby enhancing loss of the spinning energy. When compared with conventional designs, the invention effectively reduces the spin rate and increases the ball carry when the golf ball is hit with a driver club. Therefore, a player using a golf ball made according to the present invention can get better performance. Further, the number and total volume of the depressions are controlled within a predetermined range to facilitate the design of the ball and the separation of the core from the mold during its fabrication. Therefore, the invention greatly improves the production efficiency and yield rate, suitable for mass production.

TABLE I

Core/Inner core/Outer core

| Rubber compound | A | B | C |
|---|---|---|---|
| TAIPOL BR0150* | 100 | 100 | 100 |
| Zinc acrylate | 27 | 25 | 23 |
| Zinc oxide | 6 | 6 | 6 |
| Barium sulfate | 16 | 16 | 23 |
| Peroxide | 1 | 1 | 1 |

*TAIPOL BR0150 is the trade name of rubber by Taiwan Synthetic Rubber Corp.

TABLE II

Cover/Inner core/Outer core

| Resin Blend | D | E |
|---|---|---|
| HPF 2000* | 100 | — |
| Surlyn ® 8940* | — | 50 |
| Surlyn ® 9910* | — | 50 |

*Surlyn ® 8940, Surlyn ® 9910 and HPF 2000 are trade names of ionomeric resins by E. I. DuPont de Nemours and Company

TABLE III

Cover/Inner cover/Outer cover

| Resin blend | F | G |
|---|---|---|
| Surlyn ® 8940* | 50 | 30 |
| Surlyn ® 9910* | 50 | — |
| Surlyn ® 6320* | — | 70 |

*Surlyn ® 8940, Surlyn ® 9910 and Surlyn ® 6320 are trade names of ionomeric resin by E. I. DuPont de Nemours and Company

TABLE IV

| | Example | | | | | | | |
|---|---|---|---|---|---|---|---|---|
| | 1 | 2 | 3 | 4 | 5 | 6 | 7 | 8 |
| Core/Inner core | | | | | | | | |
| Compound | D | D | A | A | A | A | B | B |
| Diameter (mm) | 21 | 21 | 28 | 28 | 36.8 | 36.8 | 39.3 | 39.3 |
| Weight (g) | 5.2 | 5.2 | 14.6 | 14.6 | 31 | 31 | 36.8 | 36.8 |
| Specific gravity | 0.98 | 0.98 | 1.17 | 1.17 | 1.19 | 1.19 | 1.17 | 1.17 |
| Surface Shore D hardness | 55 | 55 | 45 | 45 | 45 | 45 | 41 | 41 |
| Compression (mm) | 2.6 | 2.6 | 3 | 3 | 3 | 3 | 3 | 3 |
| Outer core | | | | | | | | |
| Compound | C | C | B | B | None | None | None | None |
| Diameter (mm)* | 39.3 | 39.3 | 39.3 | 39.3 | — | — | — | — |
| Weight (g)* | 36.8 | 36.8 | 36.9 | 36.9 | — | — | — | — |
| Specific gravity* | 1.17 | 1.17 | 1.17 | 1.17 | — | — | — | — |
| Surface Shore D hardness | 41 | 41 | 43 | 43 | — | — | — | — |
| Compression (mm)* | 3.1 | 3.1 | 3.05 | 3.05 | — | — | — | — |
| Inner cover | | | | | | | | |
| Blend | None | None | None | None | G | G | None | None |
| Thickness | — | — | — | — | 1.25 | 1.25 | — | — |
| Specific gravity | — | — | — | — | 0.97 | 0.97 | — | — |
| Surface Shore D hardness | — | — | — | — | 50 | 50 | — | — |
| Cover/Outer cover | | | | | | | | |
| Blend | F | F | F | F | F | F | F | F |
| Thickness | 1.71 | 1.71 | 1.71 | 1.71 | 1.74 | 1.74 | 1.74 | 1.74 |
| Specific gravity | 0.99 | 0.99 | 0.99 | 0.99 | 0.99 | 0.99 | 0.99 | 0.99 |
| Surface Shore D hardness | 69 | 69 | 69 | 69 | 69 | 69 | 69 | 69 |
| Depressions | | | | | | | | |
| Cross-sectional shape | cone | cone | cone | cone | cone | cone | cone | cone |
| Volume ($cm^3$) | 0.17 | 0.27 | 0.27 | 0.36 | 0.36 | 0.48 | 0.48 | 0.95 |
| Ball | | | | | | | | |
| Weight (g) | 45.3 | 45.3 | 45.4 | 45.4 | 45.2 | 45.2 | 45.2 | 45.2 |
| Diameter (mm) | 42.7 | 42.7 | 42.7 | 42.7 | 42.7 | 42.7 | 42.7 | 42.7 |
| Compression (mm) | 2.8 | 2.8 | 2.75 | 2.75 | 2.65 | 2.65 | 2.6 | 2.6 |
| COR | 0.795 | 0.795 | 0.796 | 0.796 | 0.792 | 0.792 | 0.804 | 0.804 |
| Flight performance 1** (W#1, HS42 m/s, 9.5°)*** | | | | | | | | |
| Spin rate (rpm) | 2,933 | 2,841 | 2,820 | 2,774 | 2,962 | 2,895 | 2,690 | 2,578 |
| Carry (m) | 239.6 | 240.1 | 240.2 | 241.7 | 239.1 | 240.6 | 242.3 | 245.1 |
| Total (m) | 245.2 | 246.3 | 246.5 | 248.5 | 245.6 | 246.3 | 251.0 | 255.3 |
| Flight performance 2** (I#8, HS36 m/s)**** | | | | | | | | |
| Spin rate (rpm) | 8,498 | 8,512 | 8,520 | 8,610 | 8,931 | 9,043 | 8,725 | 9,138 |
| Carry (m) | 139.5 | 138.4 | 138.3 | 137.2 | 135.2 | 134.6 | 135.8 | 134.1 |
| Total (m) | 144.6 | 141.8 | 141.6 | 139.6 | 137 | 136.2 | 137.8 | 135.4 |
| Roll (m) | 5.1 | 3.4 | 3.3 | 2.4 | 1.8 | 1.6 | 2 | 1.3 |

| | Comparative example | | | | |
|---|---|---|---|---|---|
| | 1 | 2 | 3 | 4 | 5 |
| Core/Inner core | | | | | |
| Compound | D | A | A | B | E |
| Diameter (mm) | 21 | 28 | 36.8 | 39.3 | 28 |
| Weight (g) | 5.2 | 14.6 | 31 | 36.8 | 11.2 |
| Specific gravity | 0.98 | 1.17 | 1.19 | 1.17 | 0.98 |
| Surface Shore D hardness | 55 | 45 | 45 | 41 | 48 |
| Compression (mm) | 2.6 | 3 | 3 | 3 | 2.7 |
| Outer core | | | | | |
| Compound | C | B | None | None | C |
| Diameter (mm)* | 39.3 | 39.3 | — | — | 39.3 |
| Weight (g)* | 36.8 | 36.9 | — | — | 36.5 |
| Specific gravity* | 1.17 | 1.17 | — | — | 1.16 |
| Surface Shore D hardness | 41 | 43 | — | — | 41 |
| Compression (mm)* | 3.1 | 3.1 | — | — | 2.85 |

TABLE IV-continued

| | | | | | |
|---|---|---|---|---|---|
| Inner cover | | | | | |
| Blend | None | None | G | None | None |
| Thickness | — | — | 1.25 | — | — |
| Specific gravity | — | — | 0.97 | — | — |
| Surface Shore D hardness | — | — | 50 | — | — |
| Cover/Outer cover | | | | | |
| Blend | F | F | F | F | F |
| Thickness | 1.7 | 1.7 | 1.74 | 1.74 | 1.7 |
| Specific gravity | 0.99 | 0.99 | 0.99 | 0.99 | 0.99 |
| Surface Shore D hardness | 69 | 69 | 69 | 69 | 69 |
| Depressions | | | | | |
| Cross-sectional shape | — | — | — | — | — |
| Volume ($cm^3$) | — | — | — | — | — |
| Ball | | | | | |
| Weight (g) | 45.3 | 45.4 | 45.2 | 45.2 | 45.4 |
| Diameter (mm) | 42.7 | 42.7 | 42.7 | 42.7 | 42.7 |
| Compression (mm) | 2.7 | 2.8 | 2.65 | 2.6 | 2.6 |
| COR | 0.802 | 0.795 | 0.793 | 0.803 | 0.785 |
| Flight performance 1** (W#1, HS42 m/s, 9.5°)*** | | | | | |
| Spin rate (rpm) | 3,016 | 3,105 | 3,346 | 3,120 | 3,195 |
| Carry (m) | 238.1 | 237.6 | 233.8 | 235.8 | 231.2 |
| Total (m) | 244.1 | 243.2 | 240.1 | 241.6 | 237.8 |
| Flight performance 2** (I#8, HS36 m/s)**** | | | | | |
| Spin rate (rpm) | 8,398 | 8,371 | 8,394 | 8,151 | 8,249 |
| Carry (m) | 140.0 | 140.2 | 140.0 | 141.7 | 135.6 |
| Total (m) | 146.1 | 146.5 | 145.8 | 148.5 | 141.7 |
| Roll (m) | 6.1 | 6.3 | 5.8 | 6.8 | 6.1 |

*Value of inner core + outer core
**The flight performance test is done by using a swing robot of Miyamae Co., Ltd.
***The driver is SasQuatch, available from Nike, Inc.
****The No. 8 iron is Slingshot, available from Nike, Inc.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A multi-piece solid golf ball comprising:

a core, said core having multiple layers and a plurality of depressions formed on the surface of at least a first layer of said core, the number of said depressions being 6 to 70, the total volume of said depressions being 0.025 to 3.4 $cm^3$; and at least one cover enclosing said core, wherein at least one of the cover and a second layer of the core disposed outwardly of the first layer has inwardly extending appendages corresponding to the plurality of depressions.

2. The multi-piece solid golf ball of claim 1, wherein said depressions are formed on all layers of said core.

3. The multi-piece solid golf ball of claim 1, wherein the number of said depressions is in a range of 10 to 50.

4. The multi-piece solid golf ball of claim 1, wherein the total volume of said depressions is in a range of 0.1 to 2.8 $cm^3$.

5. The multi-piece solid golf ball of claim 1, wherein said depressions have a depth greater than 1 mm.

6. The multi-piece solid golf ball of claim 1, wherein said depressions have a maximum cross-sectional size greater than 5 mm.

7. The multi-piece solid golf ball of claim 1, wherein said core has a Shore D hardness of 35 to 60.

8. A three-piece solid golf ball comprising:

an inner core;

an outer core enclosing said inner core;

a plurality of depressions formed on at least one of said inner core and said outer core, the number of said depressions being 6 to 70, the total volume of said depressions being 0.025 to 3.4 $cm^3$; and a cover enclosing said outer core, wherein at least one of the cover and the outer core has inwardly extending appendages corresponding to the plurality of depressions.

9. The three-piece solid golf ball of claim 8, wherein said depressions are formed on said inner core and said outer core.

10. The three-piece solid golf ball of claim 8, wherein the number of said depressions is in a range of 10 to 50.

11. The three-piece solid golf ball of claim 8, wherein the total volume of said depressions is in a range of 0.1 to 2.8 $cm^3$.

12. The three-piece solid golf ball of claim 8, wherein said depressions have a depth greater than 1 mm.

13. The three-piece solid golf ball of claim 8, wherein said depressions have a maximum cross-sectional size greater than 5 mm.

14. The three-piece solid golf ball of claim 8, wherein said inner core and said outer core have a Shore D hardness of 35 to 60.

* * * * *